US007707662B2

(12) United States Patent
Pesta

(10) Patent No.: US 7,707,662 B2
(45) Date of Patent: May 4, 2010

(54) OBSTACLE AVOIDANCE METHOD FOR POOL COVERS USING LOCKABLE ZIPPER ELEMENTS

(75) Inventor: LeeAnn Pesta, West Babylon, NY (US)

(73) Assignee: Pool-Cover Corp., Hauppauge, NY (US)

( * ) Notice: Subject to any disclaimer, the term of this patent is extended or adjusted under 35 U.S.C. 154(b) by 876 days.

(21) Appl. No.: 11/545,348

(22) Filed: Oct. 10, 2006

(65) Prior Publication Data

US 2007/0226889 A1 Oct. 4, 2007

Related U.S. Application Data

(63) Continuation-in-part of application No. 11/394,292, filed on Mar. 29, 2006.

(51) Int. Cl.
*E04H 4/00* (2006.01)

(52) U.S. Cl. ..... 4/498

(58) Field of Classification Search ..... 4/498, 4/503, 494; 24/387–8, 433, 435–6; 160/DIG. 18
See application file for complete search history.

(56) References Cited

U.S. PATENT DOCUMENTS

| | | | |
|---|---|---|---|
| 1,135,764 | A | 4/1915 | Casey |
| 1,819,349 | A | 8/1931 | Walrath |
| 1,889,337 | A | 11/1932 | Legat |
| 2,394,732 | A | 2/1946 | Williams et al |
| 4,109,325 | A | 8/1978 | Shuff |
| 4,979,702 | A | 12/1990 | Franklin |
| 5,068,929 | A | 12/1991 | Weiner |
| 5,621,926 | A | 4/1997 | La Madeleine |
| 5,722,098 | A | 3/1998 | Stern |
| 5,727,264 | A | 3/1998 | Craig et al. |
| 6,273,114 | B1 | 8/2001 | Schaefer |
| 6,691,334 | B2 | 2/2004 | St-Hilaire |
| 6,691,361 | B2 | 2/2004 | Rolfe et al. |
| 6,895,886 | B1 | 5/2005 | Pawlowski et al. |
| 2002/0095898 | A1 | 7/2002 | Bettencourt |
| 2003/0145636 | A1 | 8/2003 | Nykoluk |
| 2003/0159342 | A1 | 8/2003 | Ruiz et al. |
| 2005/0262626 | A1 | 12/2005 | Lewis |

*Primary Examiner*—Gregory L Huson
*Assistant Examiner*—Karen Younkins
(74) *Attorney, Agent, or Firm*—Alfred M. Walker

(57) ABSTRACT

A cover for a swimming pool includes a flexible sheet of material covering substantially all of an opening into the swimming pool. A split extends within the cover. Zipper elements line edges of the cover along the split to close the split, thereby preventing debris from entering the swimming pool through the split. A locking plate member covers top and bottom sides of the zipper to secure the zipper during the off-season. The locking member includes spaced apart upper and lower plates, forming a slot therebetween, whereby the slot provides clearance for fabric edges of the zipper. A bridge section joins the plates adjacent to a rear side of the locking plate member. A recess is formed in facing surfaces of the lower and upper plates between the bridge section and a front side of the locking plate member, to accommodate the zipper elements therein.

10 Claims, 10 Drawing Sheets

OBSTACLE AVOIDANCE METHOD FOR POOL COVERS USING LOCKABLE ZIPPER ELEMENTS

RELATED APPLICATIONS

This application is a continuation-in-part of application Ser. No. 11/394,292 filed on Mar. 29, 2006 and claims benefit in part under 35 United States Code §120.

FIELD OF THE INVENTION

The present invention relates to securing pool covers around protruding obstacles, and to gain access to covered relaxation spas.

BACKGROUND

Pool covers for in-ground pools are attached by taut straps at the periphery of the cover which are attached to anchors in the decking around the pool. The flexible cover is to lay taut over the edge of the pool roughly in a plane parallel to the water surface.

Unfortunately, obstructions which extend vertically over the level of the pool edge often interfere with the pool cover. These may be poles or columns supporting canopies or roofs close to the edge of the pool; other obstructions such as a handrail adjacent steps leading to the pool bottom may actually extend into the pool water region.

In these areas, the pool cover must be split to permit the cover to go around the obstacle so that it can again lay horizontally at the level of the decking or pool edge. The split area must be again attached to maintain the integrity of the pool cover.

Currently, a series of straps and buckles are used to re-join the edges of the split regions of the pool cover. These straps and buckles add weight to the pool cover in localized areas making installation and removal more cumbersome. They also aesthetically detract from an otherwise streamlined appearance. Extra personnel are sometimes required to handle the cover in the obstacle areas and also to detach and re-attach straps which are rather labor intensive.

The prior art shows the use of zippers attached to pool covers. U.S. Pat. No. 4,109,325 of Shuff describes an inflatable pool cover with integral weighted skirts which are usually submerged. By introducing pressurized air under the pool cover, it can be made to rise above the edge of the pool.

U.S. Pat. No. 5,621,926 of La Madeleine describes a swimming pool cover system wherein the pool cover is attached to the periphery of the pool, but the center is raised by a cable on a boom to form a type of tent canopy over the pool.

In both of these patents of Shuff '325 and La Madeleine '926, zippers in the pool cover are used to permit a sealable opening to admit swimmers to use the pool with the pool cover attached, to take advantage of the space provided between the pool surface and the pool cover.

U.S. Pat. No. 5,722,098 of Stern describes a pool cover with drainage and filter means, wherein the filter and drain region is attached to the central region of a pool cover by some mechanism, among which is a zipper.

U.S. Pat. No. 6,691,334 of St-Hilaire describes a swimming pool covering structure in two parts. In St-Hilaire '334, the zipper is an integral part of the actual covering of the pool. A flexible central section extends over the water area of the pool. A flexible anchoring section is attached to the edge of an above-ground pool or to the deck surface around an in-ground pool much like a frame. The central section is then attached to the anchoring section using a long zipper extending all the way around the edge of the pool.

None of the cited prior art patents make use of one or more sliding zipper elements to permit a pool cover to be fitted around vertical obstacles over the water or deck areas. None of the cited patents uses a zipper to make a certain part of the covered areas removable to gain access to an adjacent feature, such as a spa area.

Also, the prior art does not relate to safety pool covers which must comply with ASTM specifications.

OBJECTS OF THE INVENTION

It is therefore an object of the present invention to provide a pool cover which is fitted tightly and securely around vertically extending obstacles and/or auxiliary structures such as spas.

Other objects which become apparent from the following description of the present invention.

SUMMARY OF THE INVENTION

The QUIK-LOC™ zipper system of the present invention is a heavy duty sliding zipper element rated at 600 pounds per inch, which is the same rating as the rest of a pool cover. This maintains the flexible cover taut to meet ASTM standards for safety. The QUIK-LOC™ zipper system provides a convenient method of navigating around any vertical obstacles that may be within the pool cover area.

Currently, when a vertically extending obstacle, such as an entrance stair hand rail extends above the surface of a swimming pool cover, the swimming pool cover is split in the area of the obstacle, but numerous straps and buckles need to be joined together along the length of the open area to rejoin the two edges together to maintain the integrity of the pool cover.

Gaps are left between the two edges which permit debris such as leaves and twigs to enter the pool area between the straps. The buckles and straps add weight to the pool cover and require additional time to secure each strap.

The use of the QUIK-LOC™ zipper, instead of the conventional array of straps, closes the split area around the obstacle quickly and neatly, improving the aesthetic appearance, by substituting the clean uniform look of a zipped section for the ragged appearance of numerous straps with free hanging ends.

The sliding zipper also prevents the entrance of debris into the pool around the split area.

To secure the QUIK-LOC™ zipper in place and prevent a child or other unauthorized person from opening it, a fastener, such as a flexible cable (preferably stainless steel), is passed through the handle area of the slide or latching mechanism of the QUIK-LOC™ zipper (it is noted that the slide is about two inches long).

The cable is then looped through two "D" rings sewn at the end of each side of the looped area. A locking fastener, such as a padlock hasp is then passed through the loops which are at both ends of the cable. Preferably the distal end of the zipper is covered by a removable protective plate, to protect the head of the closed zipper when the zipper is installed in place, joining portions of the pool cover.

A second application for QUIK-LOC™ is for ease in removal to access a particular area of a pool, such as a spa area. The area when not in use can be zipped and covered, still maintaining the safety cover feature, but when entry is needed, only a quick unzippering and removal of certain springs with straps need be removed to access to the desired area.

The process still will require the unlocking of the lock by an authorized person, but the time and effort involved after will be greatly reduced.

Once the area is no longer needed, it just need be re-zipped and locked via cable and padlock and attachment of the springs and straps. It should be noted that during the uncover of any section, the pool cover is not considered safe again until the area removed is replaced, the QUIK-LOC™ is re-zipped, and cable is again installed and locked to meet ASTM standards.

In use, the swimming pool is covered by navigating around any vertical obstacles, such as access handrails, that may be within the pool cover area. The pool cover is split into one or more laterally extending cuts, each having a pair of joinable edges from a peripheral edge to an open area of a vertically extending obstacle extending above the pool cover. The joinable edges are joined by a heavy duty zipper, thereby capturing the obstacle along the length of the split laterally extending cut open area to rejoin the two edges together. The zipper closes respective gaps left between the two edges of the zipper and prevents debris such as leaves and twigs to enter the pool area between the joinable zipper edges.

The heavy duty sliding zipper is secured in place to prevent a child or other unauthorized person from opening it by a lock. In one embodiment, a cable having closed loops at opposite ends thereof is provided. The cable is passed through a handle area of the heavy duty sliding zipper and then through one or more rings attached at an end of each respective side of the looped area of said cable. A lock, such as a padlock, is passed through the pair of loops at the respective opposite ends of the cable.

The present invention can also be used to allow access to a pool spa located in a region adjacent to the main swimming pool, independent of the swimming pool being covered. An extension flap to the pool cover extending from one or more edges of the pool cover while covering the spa. The flap is zippered to allow entry into said spa area without removal of the main pool cover from the swimming pool. The pool cover extension flap is split into a pair of laterally extending cuts, each having a pair of joinable zipper edges. The cuts extend from an outer distal peripheral edge thereof to an open area between a spaced apart edge of the spa closest to the pool. The two splits extend beyond the outer lateral edges of the spa. When not in use, the spa can be covered and secured by a similar locking means as provided for the splits in the main pool cover, such as by also providing a cable having closed loops at opposite ends thereof and passing the cable through a handle area of said heavy duty sliding zipper and passing the cable through a plurality of rings attached at an end of each respective side of the looped area of the cable. A padlock hasp is then passed through the pair of loops at the opposite ends of the cable.

The zipper closes the split area around the main swimming pool obstacle or adjacent spa area quickly and neatly. The zipper also prevents the entrance of debris into the pool around the split area.

A preferred embodiment of locking method for securing the QUICK-LOC™ zipper during off-season involves the use of a locking plate. In this method, the zipper has two holes adjacent to its open end. After closing the zipper, the slide is removed from the zipper by sliding it off the end. A heavy-duty locking plate (typically aluminum, brass or stainless steel) with two holes in registration with those of the zipper is then installed from the open end. The locking plate is in the form of a top plate and a bottom plate attached by a small region and leaving edge slots which fit the zipper fabric. The central internal region has a form-fitting recess which accepts the interlocking teeth of the zipper. Then the free end of the cable of a cable lock is threaded through the open area of the slide handle and then thorough one of the holes in the locking plate and zipper. The free end is then threaded through the other zipper and plate holes from the underside, emerging to the top surface and then secured by the cable lock.

In this manner, the zipper is secured in a closed position, and the slide is stored in an adjacent secured location.

A flap of heavy rubberized or resilient waterproof material is optionally sewn on one side of the zipper. It can be easily lifted to operate the zipper, but when flipped over the zipper, it offers protection from snow and ice in the off-season.

BRIEF DESCRIPTION OF THE DRAWINGS

The present invention can best be understood in connection with the accompanying drawings. It is noted that the invention is not limited to the precise embodiments shown in drawings, in which.

DETAILED DESCRIPTION OF THE INVENTION

Figure 1:
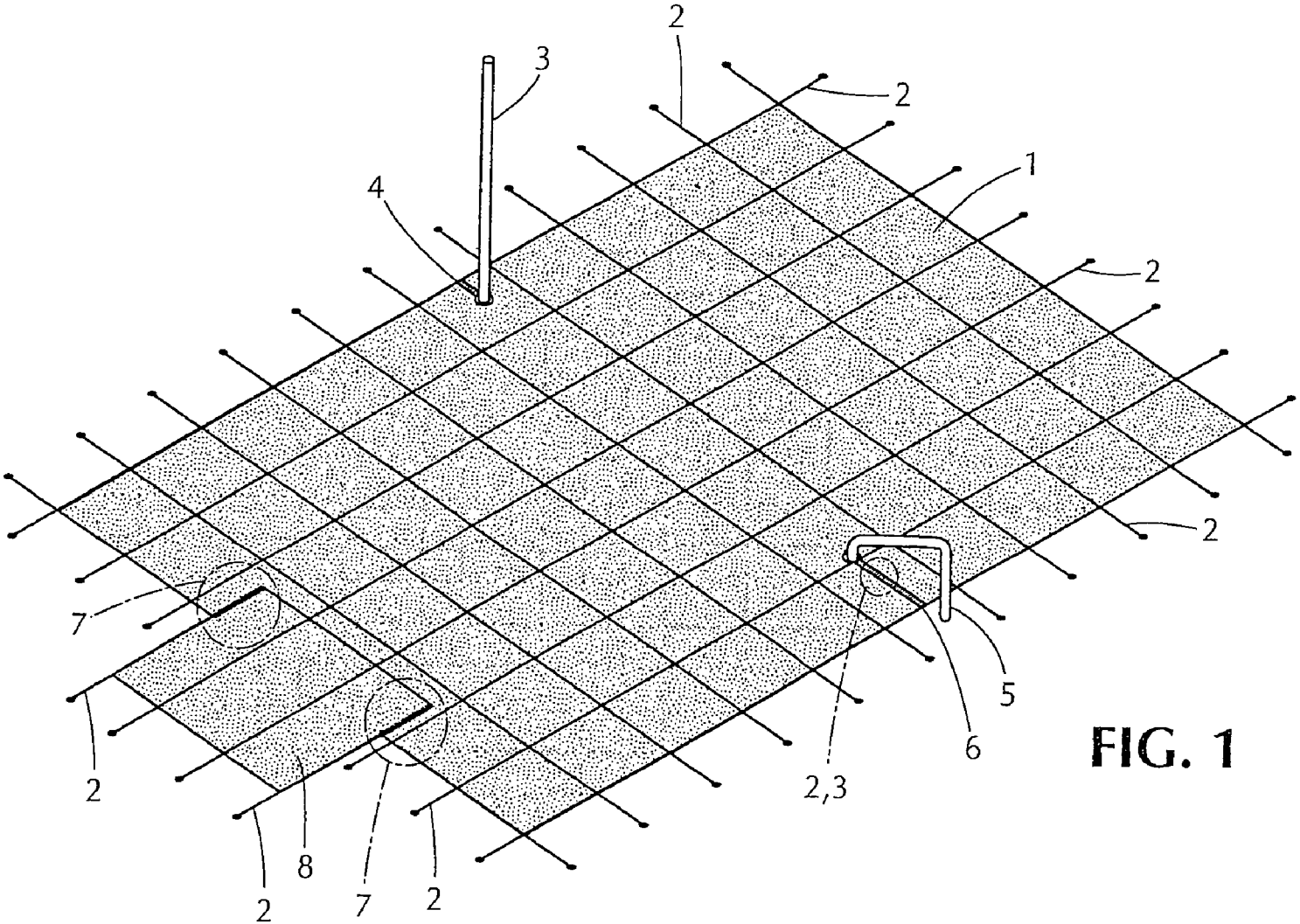
FIG. 1 is a perspective view of a pool with safety pool cover showing obstacles and a separate end area covering a spa section.

The general method of accommodating vertical obstacles protruding through safety pool covers is shown in FIG. 1. Pool cover 1 with taut attachment straps 2 attached to the deck area is penetrated by pole 3 and handrail 5. In both cases, the edge is split (at 4 and 6 respectively) to navigate around the obstacle. In both cases the splits are re-closed to maintain the safety integrity of pool cover 1. Pool cover extension 8 covers a separate spa area adjacent to the main pool. It is attached to the main section of pool cover by a removable closure system at line 7 to permit use of the spa area without the need to detach tension straps 2. The attachment technique is regulated by ASTM to insure the safety integrity of pool cover 1.

Figure 3:
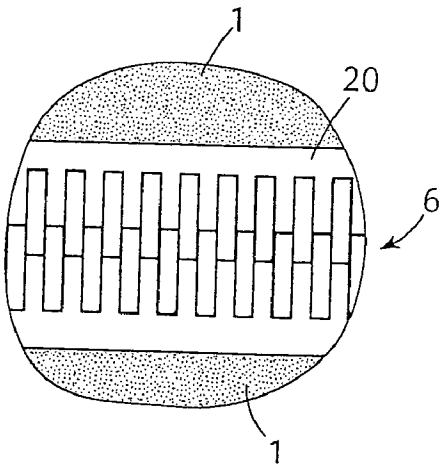
FIG. 3. Is a top view detail of the same area as in FIG. 2 as it appears with the QUIK-LOC™ zipper of this invention.
Figure 2:
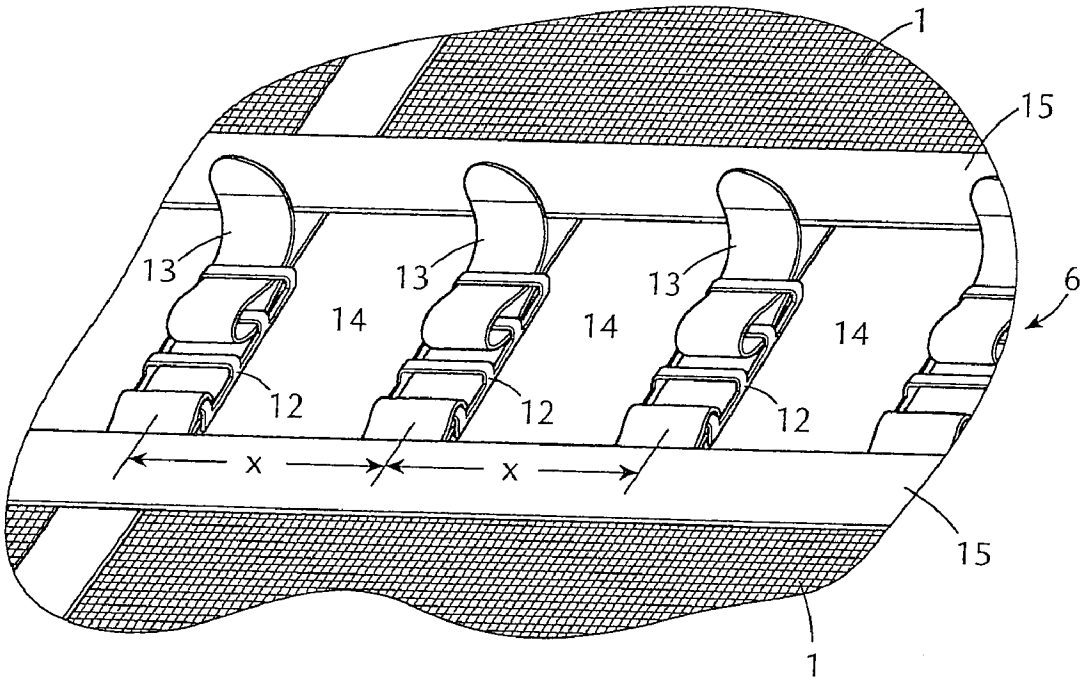
FIG. 2 PRIOR ART
FIG. 2 is a perspective detail of the prior art method of using multiple straps and buckles to close a split area under a handrail shown in FIG. 1.

The method used for removable closure of obstacle splits or removable pool cover extensions of this invention is to use a sliding QUIK-LOC™ heavy duty zipper to replace the prior art array of straps. The differences between the appearance of the two methods is illustrated in FIGS. 2 and 3. These are enlarged details of the area indicated under the handrail of FIG. 1.

FIG. 2 shows prior art straps 13 engaged with buckles 12 closing a split between two edges of pool cover 1 as lined with reinforcing ribbons 15. Open regions 14 are visible between straps and buckles. Regulations specify the strap spacing "X" to be 3" over water and every 6" over decking to maintain the pool cover strength integrity. The time to engage or disengage such an array of straps is quite long and tedious.

As a contrast, the neat appearance of QUIK-LOC™ zipper 20 closing split 6 is shown in FIG. 3. It is noted that no open spaces comparable to regions 14 are evident since QUIK-LOC™ zipper 20 prevents entry of debris into the pool through the split area. The time to engage or disengage zipper 20 is negligible as compared to multiple straps 13 and buckles 12. QUIK-LOC™ zipper 20 can also be used as the attachment method of cover extension 8 to main cover 1 along line 7 as shown in FIG. 1. Although illustrated as a straight line in FIG. 1, attachment junction using sliding zipper 20 can be curved as well.

Figure 5:
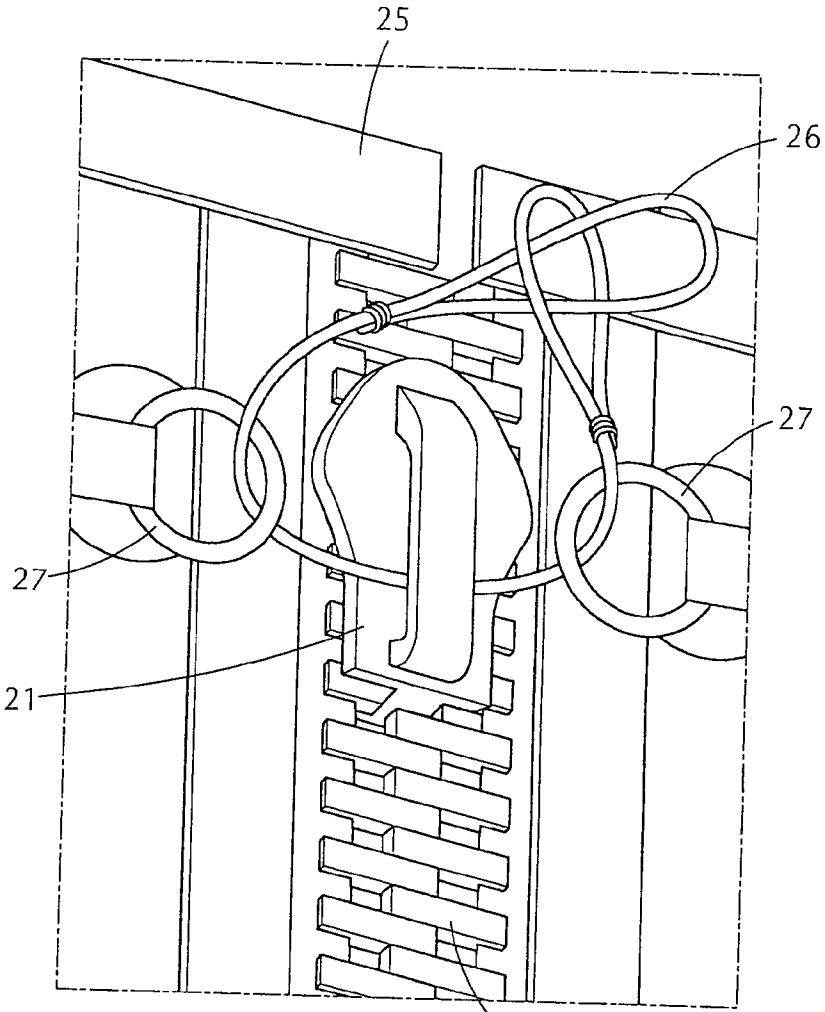
FIG. 5 is a perspective detail of the cable locking system used with the QUIK-LOC™ zipper of this invention.
Figure 4:
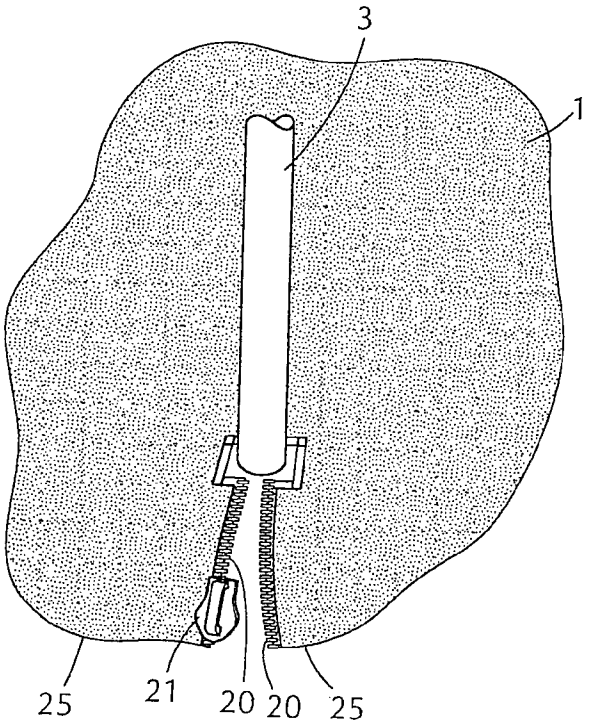
FIG. 4 is a perspective detail of an edge region of pool cover split apart to accommodate a support pole obstacle while using a QUIK-LOC™ zipper.

FIG. 4 illustrates the placement of an open split using sliding zipper 20 around the obstacle of pole 3 at the edge 25 of pool cover 1. Slide 21 is engaged with one side of the open sliding zipper 20. FIG. 5 shows the locking method. The locking system of QUIK-LOC™ zipper 20 involves the use of cable 26 which has loops at each end. This is guided under the handle of slide 21 as shown which has a slot to accommodate the loops at the ends of cable 26. Cable 26 is also looped through closed rings, such as "D" rings 27, which are sewn to each side of the split. A padlock (not shown) hasp is then conveniently engaged through both cable 26 loops and snapped locked.

Figure 6:
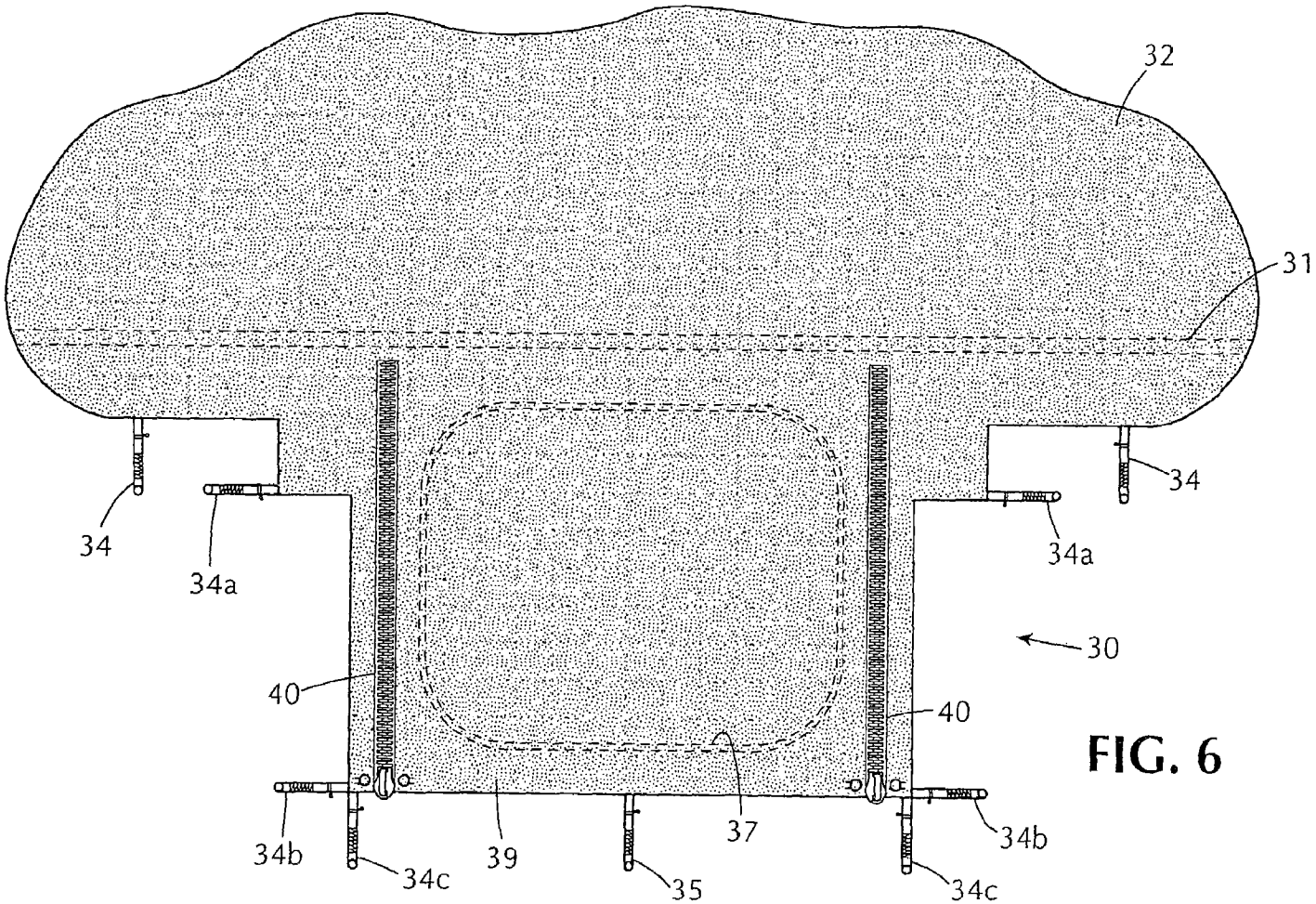
FIG. 6 is a top view detail showing two parallel QUIK-LOC® zippers used to cover a rectangular spa area adjacent to a pool with an extension of the main safety pool cover.
Figure 7:
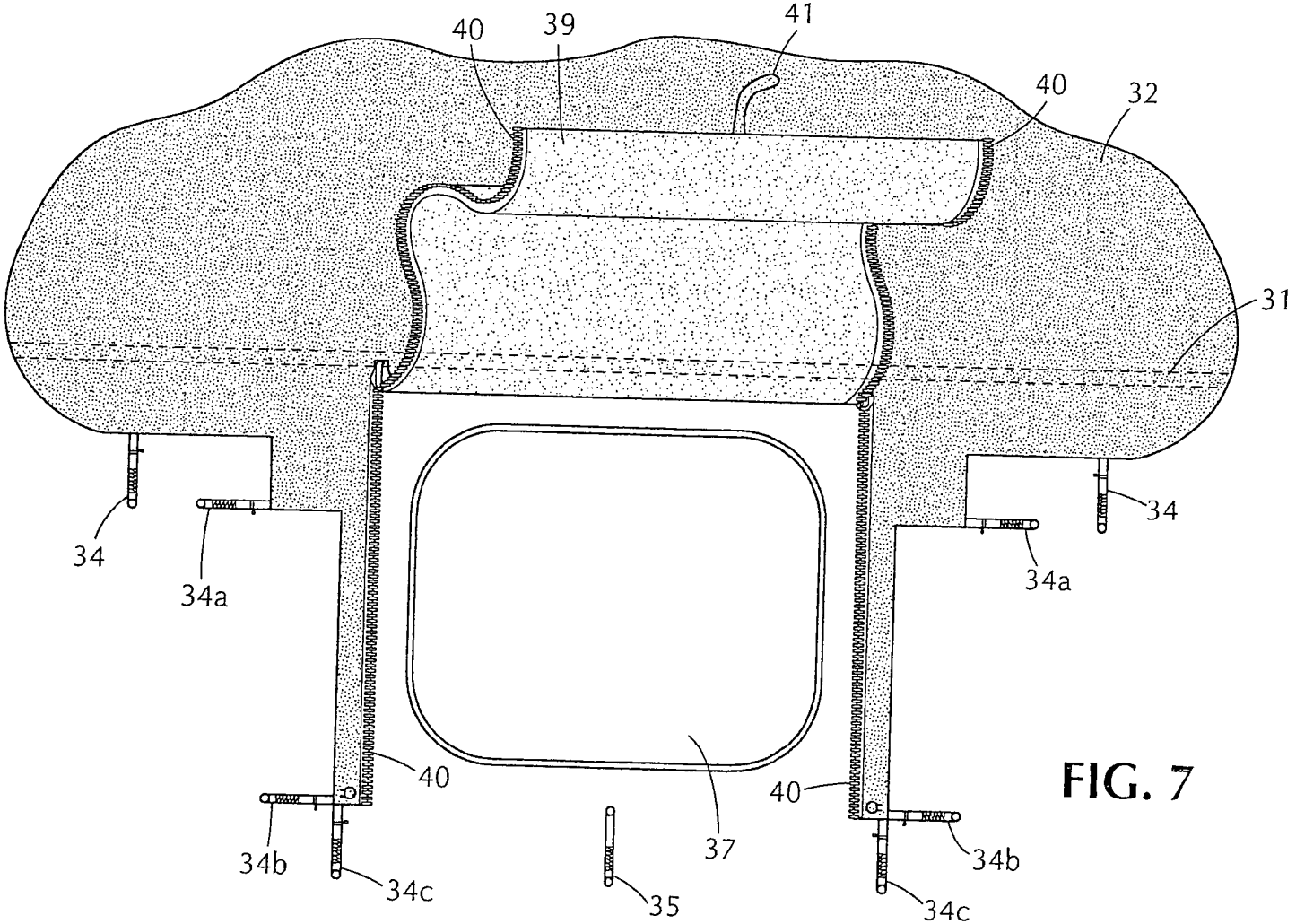
FIG. 7 is a top view of the same detail as that in FIG. 6 with the movable flap opened to gain access to the spa.
Figure 8:
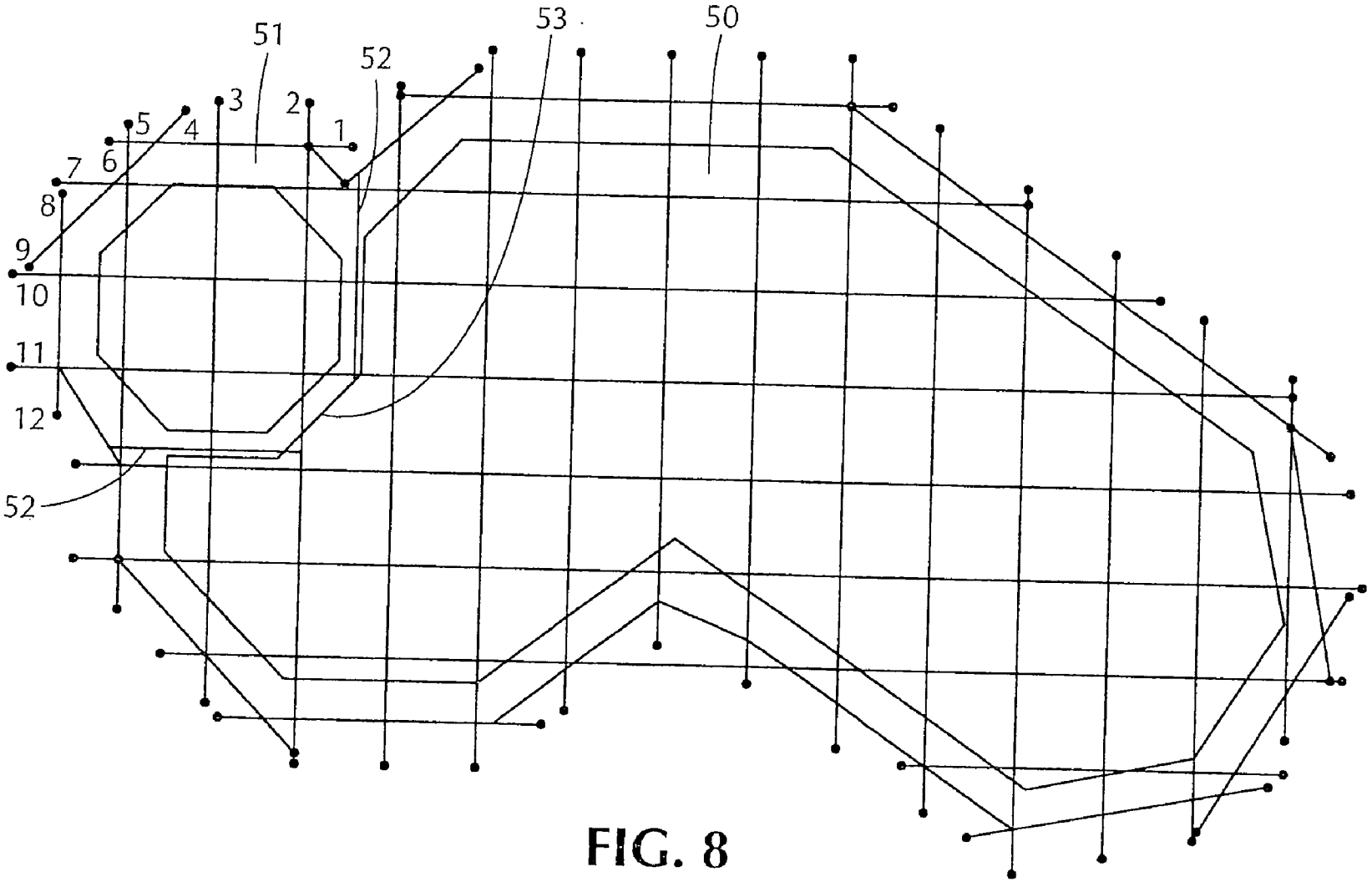
FIG. 8 is a top plan view of an angular shaped pool with a spa area adjacent one end covered by an extension of the main pool safety cover and using two QUIK-LOC® zippers at right angles to each other.

Multiple QUIK-LOC® zippers are sometimes used on extensions of pool safety covers to cover adjacent features such as a spa. FIGS. 6 and 7 illustrate the use of two parallel zippers to cover a rectangular spa, while FIG. 8 shows a plan for using two zippers at right angles to each other to cover a 7-sided angular spa. Obviously two or more QUIK-LOC® zippers at various angles can be used to accommodate other custom installations.

FIG. 6 shows safety pool cover extension 30 which is part of main pool cover 32 used to cover spa 37 which is adjacent to the edge 31 of the pool. Movable flap 39 is shown zipped in place by QUIK-LOC® zippers 40 thereby covering spa 37. Tension deck straps 34 attach the main pool cover 32 as well as extension 30 to the deck surface.

Central straps 35, 34*a* and 34*b* are the only ones that needs to be undone to permit use of the spa area as shown in the accessible configuration in FIG. 7. Strap end 41, 34*a* and 34*b* are detached from anchors prior to unzipping zippers 40, then flap 39 is simply folded over main cover 32.

FIG. 8 shows main safety pool cover 50 with an extension 51 covering an adjacent angular spa area. Here two QUIK-LOC® zippers 52 at right angles to each other are used to gain access to the spa area by unzipping and folding the entire extension 51 over main cover 50 creating a fold at a line intersecting the close ends of zippers 52 (indicated by item number 53). Only the deck straps around the periphery of the spa area need be undone.

Figure 9:
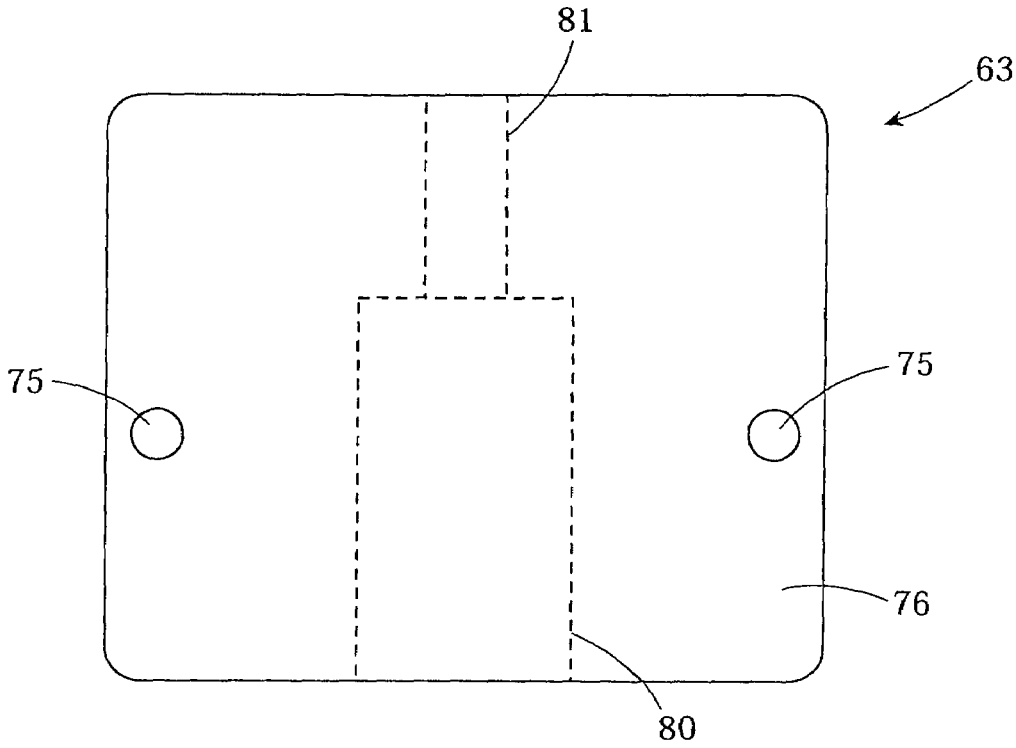
FIG. 9 is a top plan view of a locking plate of this invention.
Figure 10:
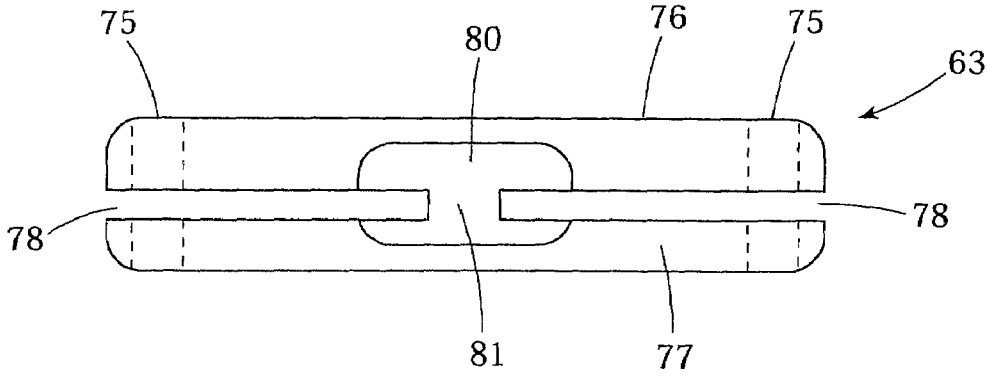
FIG. 10 is a front elevation of the locking plate showing the central recess, side slots, and plate attachment rib.
Figure 11:
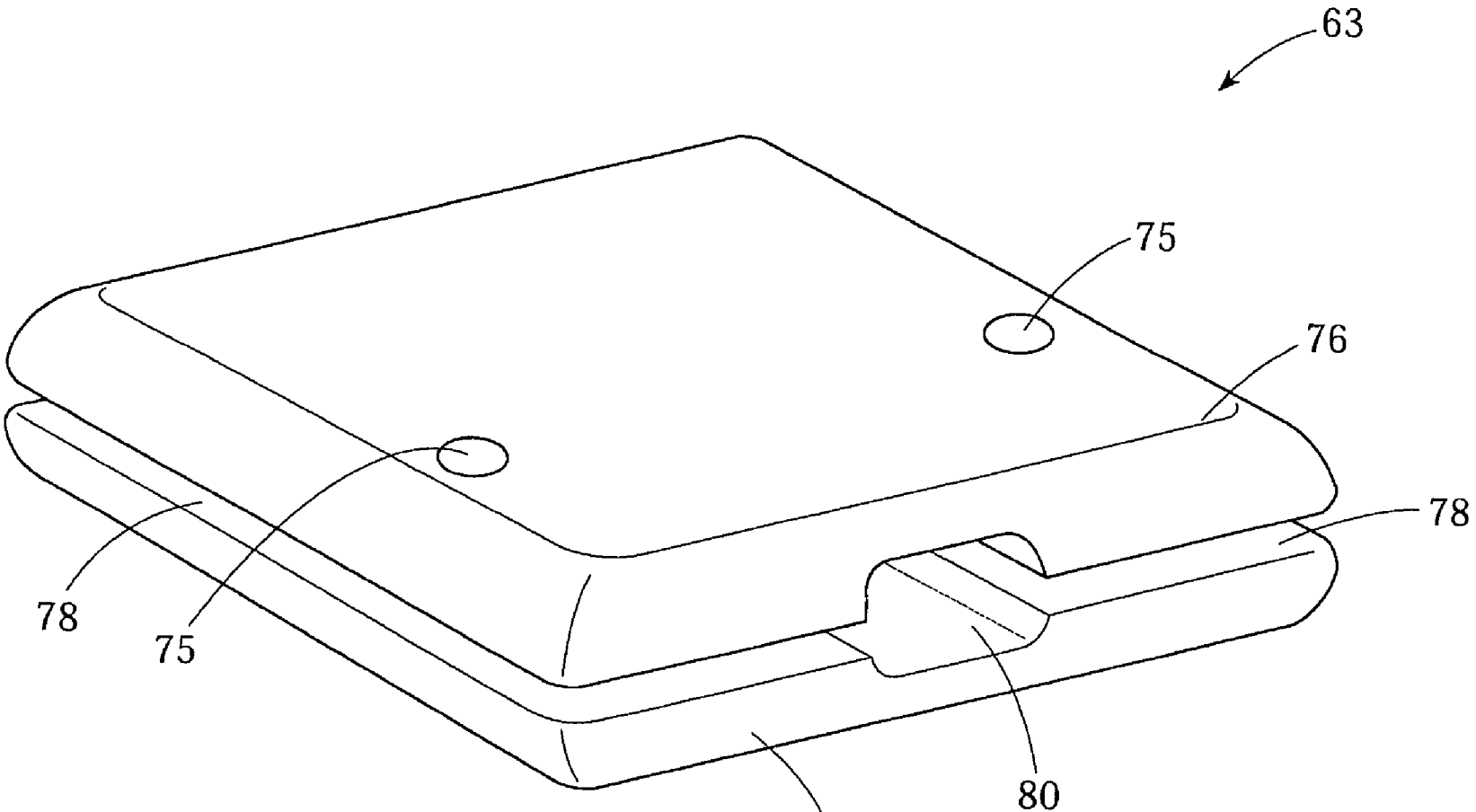
FIG. 11 is a perspective view of the locking plate.

FIGS. 9, 10 and 11 shows various views of locking plate 63 which is used to secure zipper 20 during the off-season. Locking plate 63 includes upper plate 76 attached to lower plate 77 via bridge section 81 leaving slot 78 which encircles bridge 81. Slot 78 provides clearance for the fabric of zipper 20. A wider central front recess 80 is provided to fit over the teeth of zipper 20. In operation, the front of locking plate 63 is slid over the end of closed zipper 20 so that holes 75 line up in registration with those of zipper 20.

Figure 12:
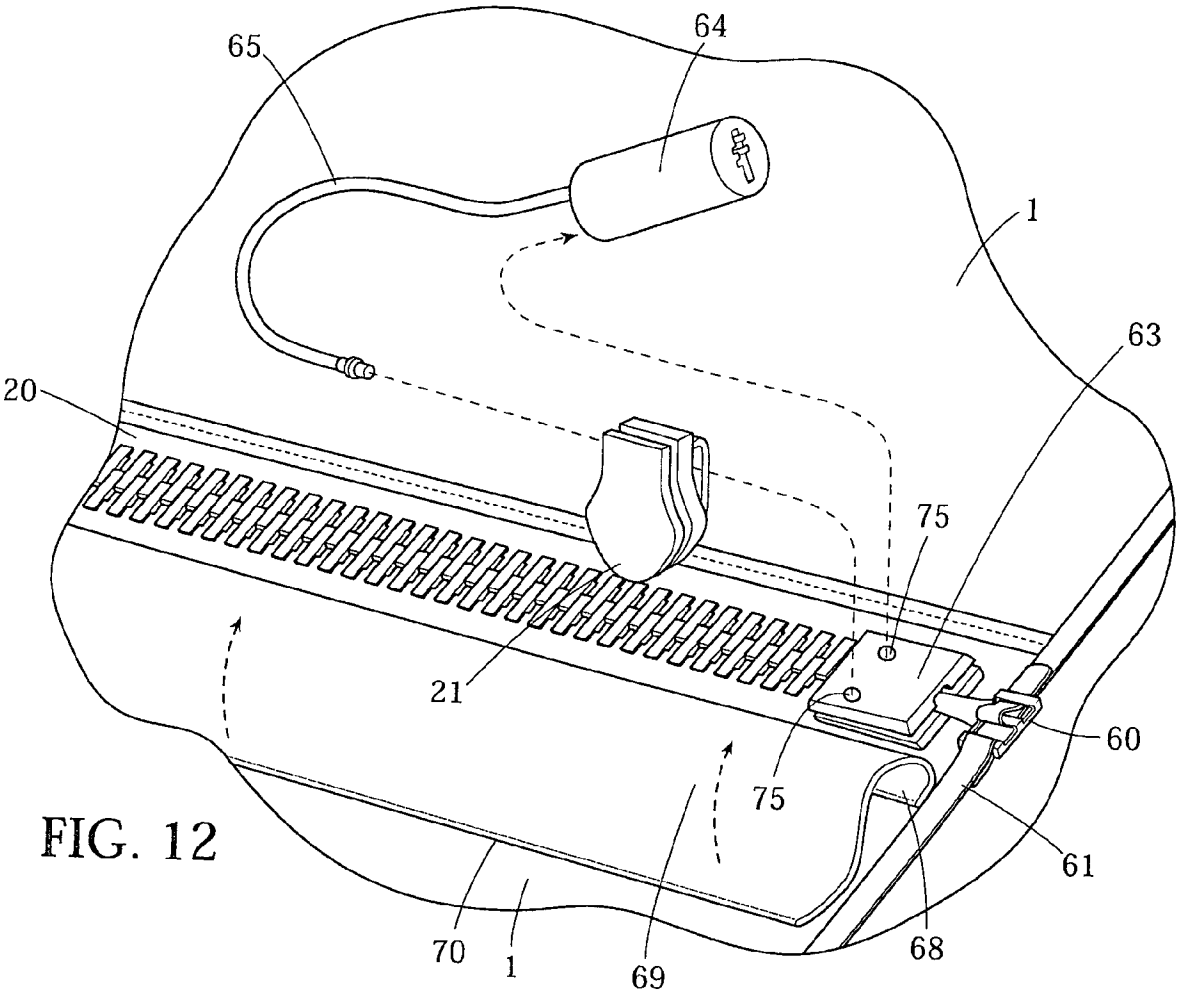
FIG. 12 is an exploded perspective detail view of the components of an alternate embodiment of zipper locking method using a locking plate.
Figure 13:
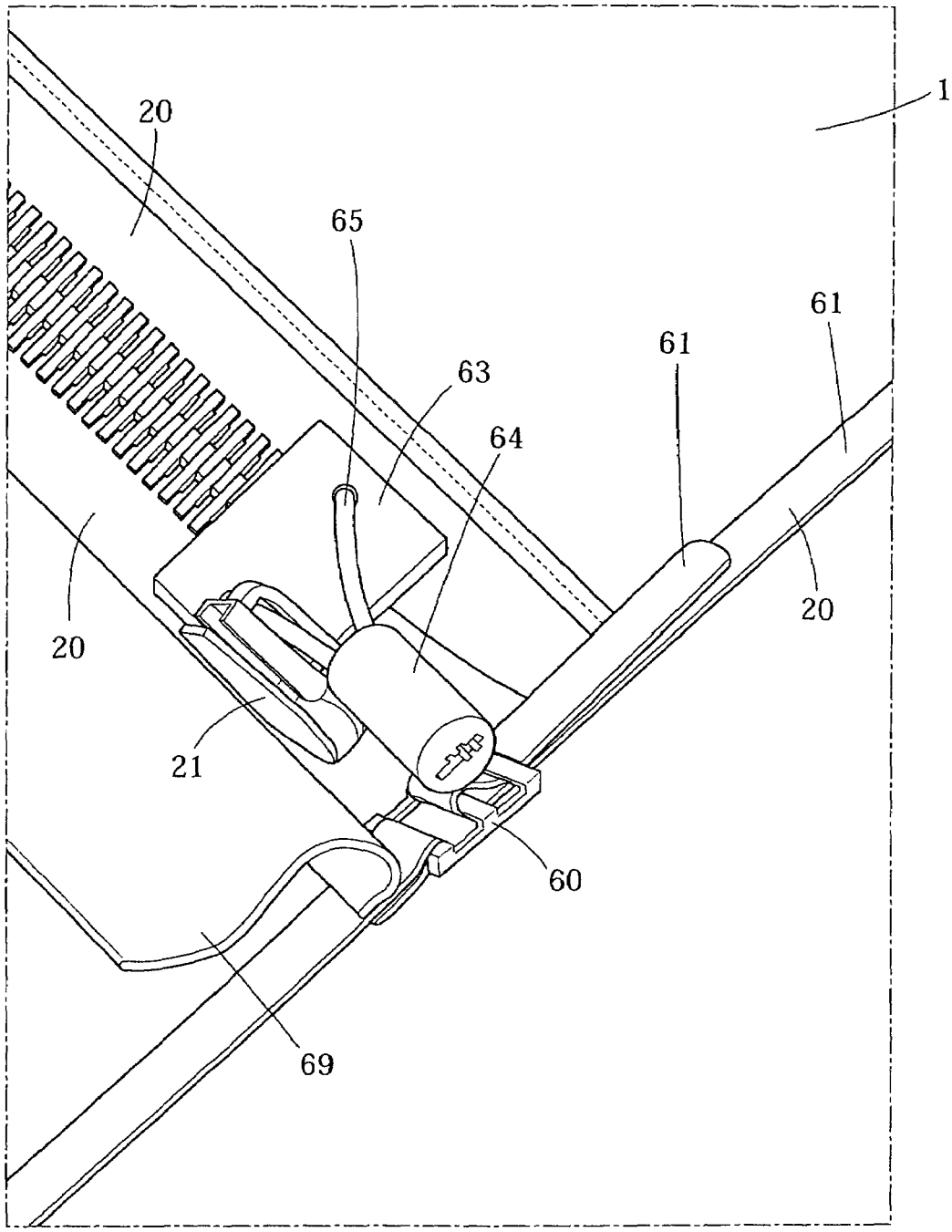
FIG. 13 is a perspective view of a locking plate in use with a cable lock.

The alternate method of locking zipper 20 using locking plate 63 is shown in FIGS. 12 and 13.

FIG. 12 is a detail of the open end region 60 of zipper 20 with an exploded view of the locking method. A reinforcing strip 61 is sewn to pool cover 1 at the edge; it also has a strap extension which closes the free ends using a buckle. It is noted that slide 21 has been removed from zipper 20 by just sliding it off the end. Cable lock 64 with attached cable 65 is shown above locking plate 63. The holes 75 of plate 63 are placed in registration with holes on either side of the end section of zipper 20. Cable 65 is then threaded (as shown by dashed lines) through the open handle of slide 21, then through one plate hole 75 and through one of the zipper hole, then up through the other hole 75 from the bottom of locking plate 63 to be locked within cable lock 64.

The locked configuration is shown in FIG. 13. Flap 69 is provided with inner sewn edge 68 and free edge 70. This is flipped over zipper 20 and the locking hardware during the off-season therefore offering protection from the elements. It offers no inconvenience during the use season as it is simply folded as shown in the drawing Figures to operate zipper 20.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended claims.

I claim:

1. A cover with a swimming pool comprising:

a flexible sheet of material covering substantially all of an opening into said swimming pool, said swimming pool having one or more upwardly extending obstacles;

an opening in said flexible sheet of material shaped to correspond to an outer contour of each of said obstacles when said cover is deployed on said swimming pool;

a split in said flexible sheet of material extending from each said opening to a side of said cover;

a zipper comprising zipper elements lining edges of said cover along said split to zipper shut said split from said side of said cover to said opening, said zipper elements terminating at, and not extending along an edge of said opening, thereby preventing debris from entering said swimming pool through an area of said split; and a locking member covering top and bottom sides of said zipper adjacent to said side of said cover for securing said zipper during off-season.

2. The cover of claim 1 in which said locking member comprises:

a lower plate;

an upper plate spaced from said lower plate forming a slot between the lower and upper plates, said slot providing clearance for fabric of said zipper;

a bridge section joining said lower and upper plates adjacent a rear side of said locking member with said slot encircling said bridge section; and a recess formed in facing surfaces of said lower and upper plates between said bridge section and a front side of said locking member to accommodate said zipper elements.

3. The cover of claim 2 in which said locking member has a pair of spaced apertures on opposite sides of said zipper, a cable threaded through both of said apertures, and a padlock for joining looped ends of said cable to lock said locking member on said zipper.

4. The cover of claim 3 in which said pool cover has straps mounted on an edge thereof on opposite sides of said zipper and a buckle for attaching free ends of said straps.

5. The cover of claim 3 in which a slide for said zipper, being separated from said zipper elements, has an opening through which said cable is threaded.

6. The cover of claim 3 in which said pool cover has a flap for covering said zipper and locking member.

7. A method of covering an opening in a swimming pool having upwardly extending obstacles comprising the steps of:

placing a flexible sheet of material over substantially all of said opening into said swimming pool, said flexible sheet of material having an obstacle opening corresponding to each of said obstacles when said cover is deployed on said swimming pool and a split extending from each obstacle opening to a side edge of said flexible sheet of material;

using a slide to close zipper elements lining edges of said split to zipper shut said split from said side edge of said flexible sheet of material only up to said obstacle opening, thereby preventing debris from entering said swimming pool through an area of said split; and mounting a locking member covering top and bottom sides of said zipper adjacent to said side of said cover for securing said zipper during off-season.

8. The method of claim 7 in which said locking member is slid over free ends of said zipper elements, said locking member comprising a lower plate, an upper plate spaced from said lower plate forming a slot between the lower and upper plates to accommodate fabric supporting said zipper elements, a bridge section joining said lower and upper plates adjacent a rear side of said locking member along an outer edge of said pool cover, and a recess formed in facing surfaces of said lower and upper plates between said bridge section and a front side of said locking member to accommodate said zipper elements.

9. The method of claim 8 in which a cable is threaded through a pair of spaced apertures in said locking member on opposite sides of said zipper, and a padlock is mounted for joining looped ends of said cable to lock said locking member on said zipper.

10. The method of claim 9 in which straps are mounted on an edge of said pool cover on opposite sides of said zipper and buckled together for attaching free ends of said straps.

* * * * *